US008550781B2

(12) United States Patent
Zha et al.

(10) Patent No.: US 8,550,781 B2
(45) Date of Patent: Oct. 8, 2013

(54) HEAT DISSIPATION FAN AND ROTOR THEREOF

(75) Inventors: Xin-Xiang Zha, Shenzhen (CN); Ye-Fei Yu, Shenzhen (CN); Jer-Haur Kuo, Taipei Hsien (TW)

(73) Assignees: Fu Zhun Precision Industry (Shen Zhen) Co., Ltd., Shenzhen (CN); Foxconn Technology Co., Ltd., New Taipei (TW)

( * ) Notice: Subject to any disclaimer, the term of this patent is extended or adjusted under 35 U.S.C. 154(b) by 831 days.

(21) Appl. No.: 12/752,148

(22) Filed: Apr. 1, 2010

(65) Prior Publication Data

US 2011/0182737 A1 Jul. 28, 2011

(51) Int. Cl.
*F04D 29/38* (2006.01)
*F01D 5/22* (2006.01)

(52) U.S. Cl.
USPC ..... 416/181; 416/189; 416/194

(58) Field of Classification Search
USPC ..... 416/181, 183, 189, 194
See application file for complete search history.

(56) References Cited

U.S. PATENT DOCUMENTS

| | | | | | |
|---|---|---|---|---|---|
| 1,010,337 | A | * | 11/1911 | Wunderlich | 416/181 |
| 1,029,907 | A | * | 6/1912 | Arnold | 416/181 |
| 1,370,083 | A | * | 3/1921 | Blackmore | 416/189 |
| 4,836,748 | A | * | 6/1989 | Church | 416/181 |
| 5,405,243 | A | * | 4/1995 | Hurley et al. | 416/189 |

* cited by examiner

*Primary Examiner* — Dwayne J White
(74) *Attorney, Agent, or Firm* — Altis & Wispro Law Group, Inc.

(57) ABSTRACT

A rotor includes a hub, rotary blades extending outwardly from the hub, and an annular wall surrounding the rotary blades. Each rotary blade includes a windward lateral surface and a leeward lateral surface at opposite sides thereof. The annular wall adjoins the outer ends of the rotary blades and is rotatable therewith. A perforation is defined in the annular wall between two neighboring rotary blades and adjacent to the leeward lateral surface of a leading rotary blade of the neighboring rotary blades.

19 Claims, 6 Drawing Sheets

HEAT DISSIPATION FAN AND ROTOR THEREOF

BACKGROUND

1. Technical Field

The present disclosure relates to heat dissipation, and more particularly to a heat dissipation fan.

2. Description of Related Art

Heat dissipation fans are commonly used in combination with heat sinks for cooling electronic devices such as central processing units (CPUs).

Often, a heat dissipation fan includes a stator and a rotor. The rotor includes a hub and a plurality of fan blades extending outwardly therefrom. Each of the fan blades includes a windward lateral surface and a leeward lateral surface at opposite sides thereof. A permanent magnet is arranged in the hub and surrounds the stator. The stator includes a stator core with coils wound therearound. When electrical current is supplied to the coils, the fan blades, rotated by interaction of magnetic force of the permanent magnet and magnetic forces of the coils, generate airflow. A fan housing surrounding the stator and the rotor guides the airflow in a desired direction.

During operation, while the fan blades rotate, the housing is stationary, and a gap exists between the outer ends of the blades and the housing to avoid friction therebetween. Accordingly, the size of the fan blades is limited, which correspondingly limits the airflow. Furthermore, since cooling air is pushed by the windward lateral surface of each rotary blade to create airflow, an air pressure at a first area adjacent to the leeward lateral surface of each fan blade is much lower than at a second area adjacent to the windward lateral surface of the fan blade. Thus airflow from the second area to the first area via the gap increases the noise of the heat dissipation fan.

It is thus desirable to provide a heat dissipation fan which can overcome the described limitations.

DETAILED DESCRIPTION

Figure 1:
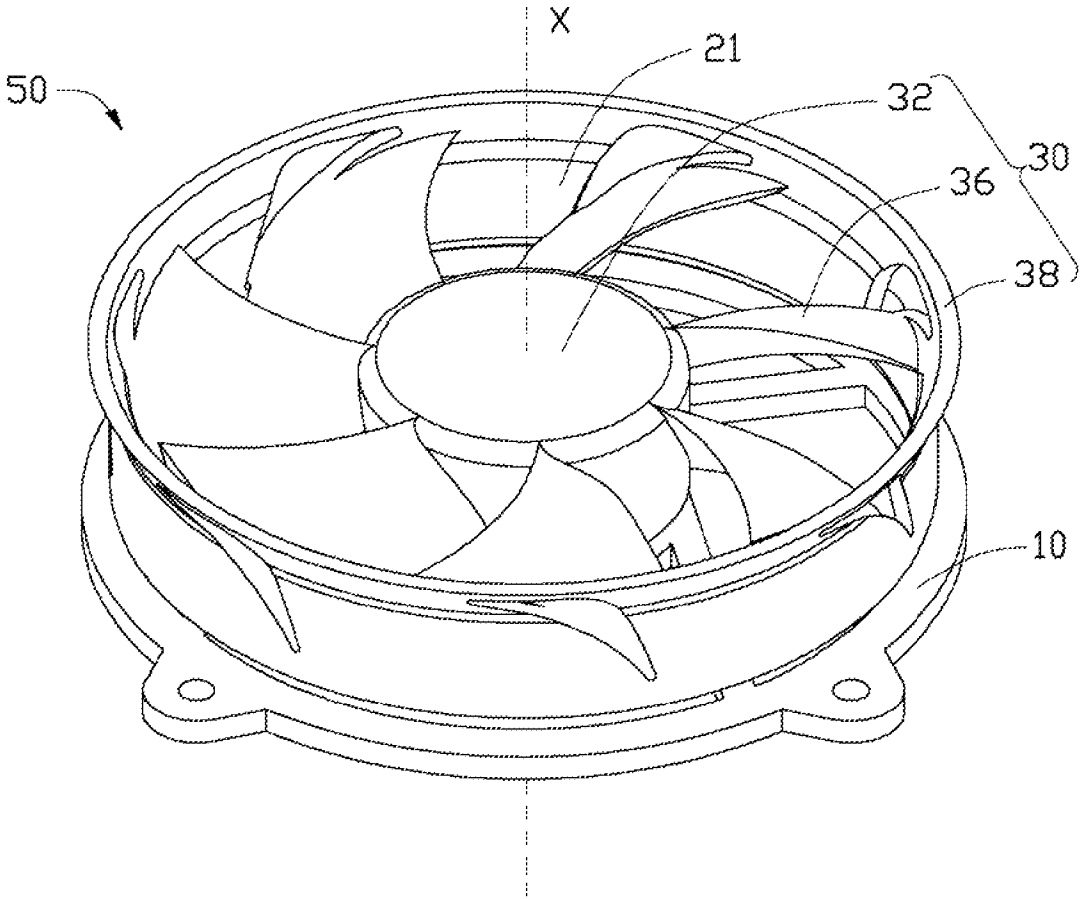
FIG. 1 is an assembled view of a heat dissipation fan according to a first embodiment of the present disclosure.

Reference will now be made to the drawing figures to describe various embodiments of the present heat dissipation fan in detail.

FIG. 1 shows an axial heat dissipation fan 50 according to an exemplary embodiment. A top of the heat dissipation fan 50 forms an air inlet 21 directing airflow into the heat dissipation fan 50, and a bottom of the heat dissipation fan 50 forms an air outlet 22 exhausting airflow from the heat dissipation fan 50.

Figure 2:
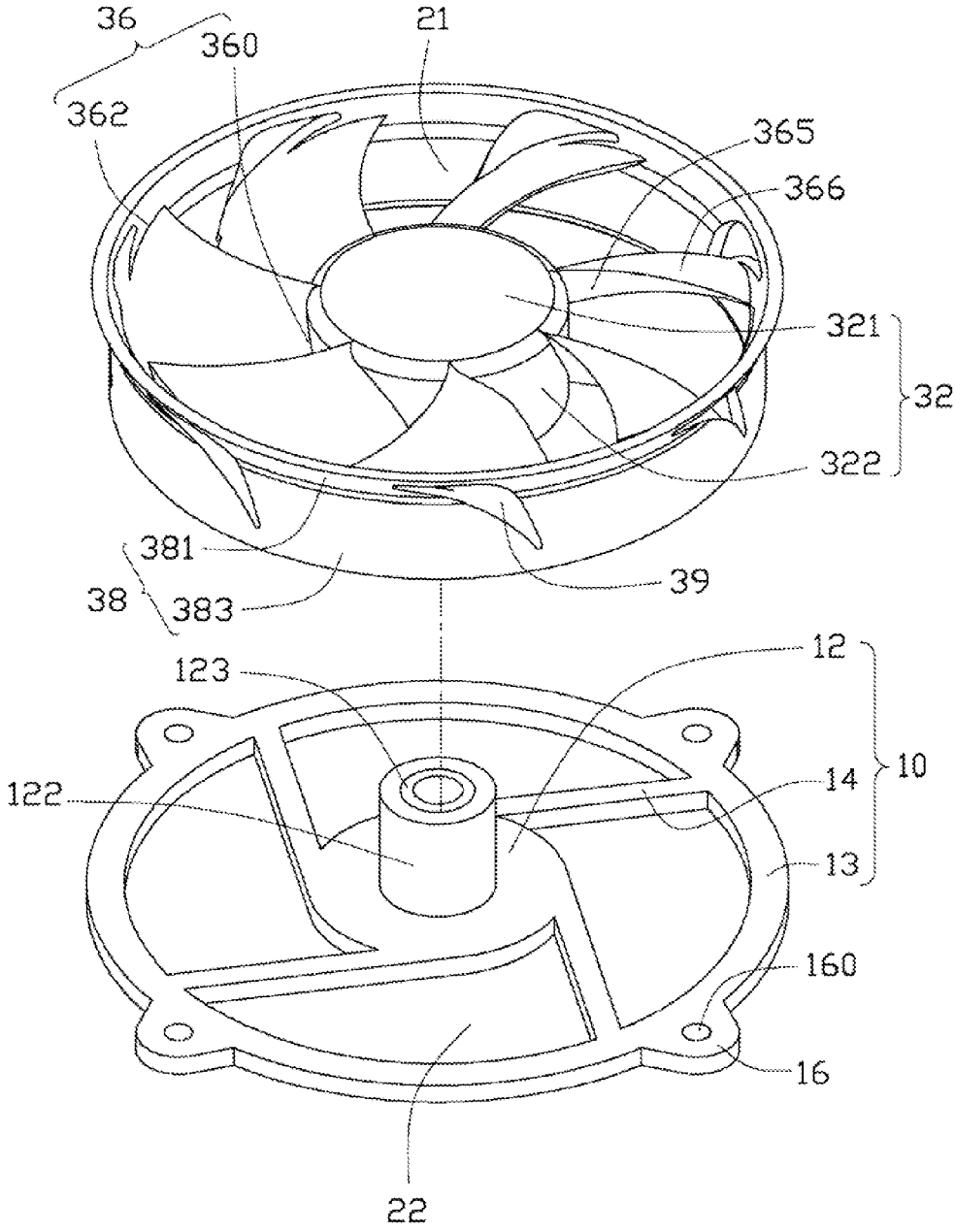
FIG. 2 is an exploded view of the heat dissipation fan of FIG. 1.

The heat dissipation fan 50 includes a base 10, a stator (not shown), and a rotor 30. Referring also to FIG. 2, the base 10 includes a circular supporting portion 12, an annular fixing portion 13 concentric with and spaced from the supporting portion 12, and a plurality of ribs 14 extending outwardly from an outer periphery of the supporting portion 12 to connect an inner periphery of the fixing portion 13. The air outlet 22 is defined between the supporting portion 12 and the fixing portion 13. The ribs 14 extend from and are evenly arranged along the outer periphery of the supporting portion 12. A plurality of fixing ears 16 extend outwardly and horizontally from an outer periphery of the fixing portion 13. The fixing ears 16 are equally spaced from each other along the outer periphery of the fixing portion 13. Each fixing ear 16 is semicircular, and defines a through hole 160 at a center thereof. A plurality of fastening elements (not shown), such as screws, can be extended through the through holes 160, respectively, to fix the heat dissipation fan 50 to another device, such as a heat sink. A central tube 122 extends upwardly from a center of the supporting portion 13. A bearing 123 is received in the central tube 122, supporting rotation of the rotor 30.

The rotor 30 includes a hub 32, a plurality of rotary blades 36 extending radially and outwardly from the hub 32, and an annular wall 38 surrounding the rotary blades 36. In the illustrated embodiment, there are seven rotary blades 36. A height of the annular wall 38 along an axis X of the rotor 30 is approximately the same as that of the rotary blades 36. A top of the annular wall 38 is approximately at the same level as a top end of each rotary blade 36. In the illustrated embodiment, the top of the annular wall 38 is slightly higher than the top end of each rotary blade 36. A bottom of the annular wall 38 is approximately at the same level as a bottom end of each rotary blade 36. The air inlet 21 is defined in the top of the annular wall 38. The hub 32 includes a circular top 321, an annular sidewall 322 extending downward from an outer periphery of the top 321, a shaft (not visible) extending downward from a center of the top 321, and an annular permanent magnet (not visible) adhered to an inner surface of the sidewall 322. When assembled, the stator is mounted around the central tube 122 of the base 10; and the rotor 30 is assembled to the base 10 via the shaft being received in the bearing 123, with the stator received in the hub 32 in the vicinity of the annular permanent magnet of the rotor 30.

Figure 3:
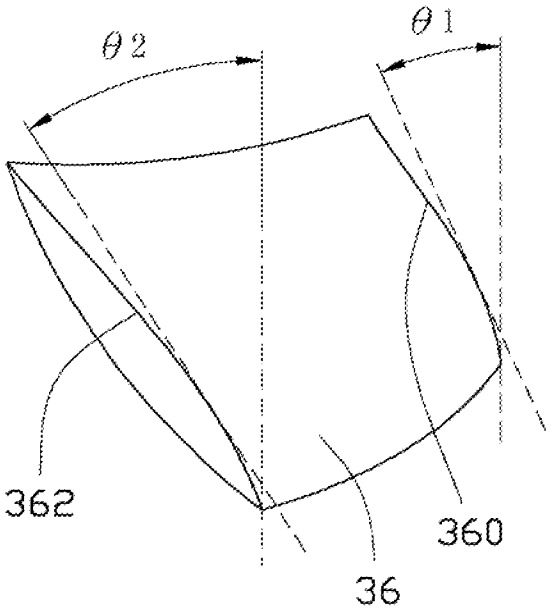
FIG. 3 is a schematic view of a rotary blade of the heat dissipation fan of FIG. 1.

Each rotary blade 36 includes an inner end 360 connected with an outer surface of the sidewall 322 of the hub 32, and an outer end 362 connected with an inner surface of the annular wall 38. The annular wall 38 connects to the outer ends 362 of the rotary blades 36 and rotates therewith during rotation of the rotor 30. Each of the rotary blades 36 is shaped so as to form varying angles with respect to the axis X of the rotor 30. Referring to FIG. 3, a first angle θ1 defined between the inner end 360 of each rotary blade 36 and the axis X of the rotor 30 is smaller than a corresponding second angle θ2 defined between the outer end 362 of each rotary blade 36 and the axis X of the rotor 30. Therefore, each of the rotary blades 36 is large. During operation, the rotary blades 36 can rotate clockwise or counterclockwise to produce airflow. In this embodiment, the rotor 30 rotates clockwise as viewed from a top of the heat dissipation fan 50 of FIG. 2. Each of the rotary blades 36 has a windward lateral surface 365 and a leeward lateral surface 366 at opposite sides thereof. The windward lateral surface 365 of each rotary blade 36 is in the form of a generally convex bulge and faces the air outlet 22. At least a portion of the leeward lateral surface 366 of each rotary blade 36 is in the form of a generally convex bulge, and the leeward lateral surface 366 faces the air inlet 21. In the illustrated embodiment, another portion of the leeward lateral surface 366 of each rotary blade 36 is generally flat.

The annular wall 38 includes a guiding portion 381 at a top, and a main enclosing portion 383 below the guiding portion 381. The guiding portion 381 gradually decreases in diameter along the axis X of the rotor 30 from top-to-bottom. The enclosing portion 383 remains constant in diameter along the axis X of the rotor 30, with the diameter being equal to the smallest diameter of the guiding portion 381. A plurality of perforations 39 is defined in the annular wall 38. In this embodiment, the number of perforations 39 is equal to the number of rotary blades 36. Each perforation 39 is located between two neighboring rotary blades 36, and is adjacent to the leeward lateral surface 366 of a front (leading) rotary blade 36 of the two neighboring rotary blades 36 along the rotation direction of the rotor 30. In the illustrated embodiment, each perforation 39 spans through both the guiding portion 381 and the enclosing portion 383.

Figure 4:
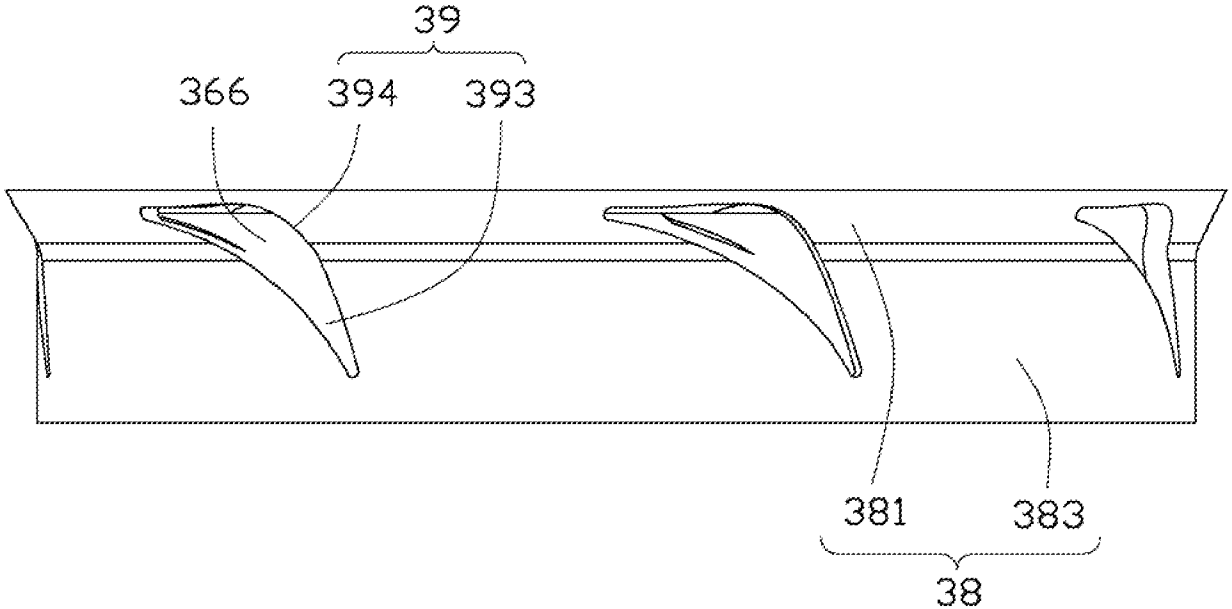
FIG. 4 is a side view of a rotor of the heat dissipation fan of FIG. 2.

Referring also to FIG. 4, each perforation 39 has a generally falcate outline. The falcate outline includes a first curved surface 393 oriented obliquely relative to the axis X of the rotor 30, and a second curved surface 394 connected with two opposite ends of the first curved surface 393. For each perforation 39, the first curved surface 393 at the enclosing portion 383 is a smooth continuation of part of the outer end 362 of the corresponding front rotary blade 36. That is, preferably, the first curved surface 393 of the perforation 39 at the enclosing portion 383 and the leeward lateral surface 366 of the front rotary blade 36 cooperatively form a single, continuous curved surface. The second curved surface 394 has a curvature exceeding that of the first curved surface 393. A distance between the first curved surface 393 and the second curved surface 394 gradually decreases from a middle of the first curved surface 393 towards each of the two opposite ends of the first curved surface 393. Thus, the perforation 39 has a width gradually deceasing from a middle thereof towards each of two opposite ends thereof.

During operation, the rotor 30 rotates by interaction of an alternating magnetic field established by the stator and the magnetic field of the annular permanent magnet of the rotor 30. The rotary blades 36 draw cooling air into an interior of the annular wall 38 from the air inlet 21, and create airflow discharged through the air outlet 22. During rotation, since cooling air is pushed by the windward lateral surface 365 of each rotary blade 36 to create airflow, an air pressure adjacent to the leeward lateral surface 366 of each rotary blade 36 is much lower than an air pressure adjacent to the windward lateral surface 365 of the rotary blade 36. Therefore a portion of the airflow has a tendency to flow from the windward lateral surface 365 of the rotary blade 36 to the windward lateral surface 365 of the rotary blade 36, thereby disrupting the desired airflow from the air inlet 21 to the air outlet 22.

Due to the perforations 39 in the annular wall 38, which are respectively located adjacent to the leeward lateral surfaces 366 of the rotary blades 36, cooling air around the outside of the annular wall 38 enters the interior of the annular wall 38 via the perforations 39 and is directly guided to the low-pressure areas at the leeward lateral surfaces 366 of the rotary blades 36. Thereby, the air pressure of the low-pressure areas is increased, and excessive generation of noise is avoided. Accordingly, the operating noise of the heat dissipation fan 50 is reduced. Additionally, the overall airflow from the air inlet 21 to the air outlet 22 can be greatly increased, thereby increasing the efficiency and effectiveness of the heat dissipation fan 50. Since the annular wall 38 rotates together with the rotary blades 36, a relative position between the rotary blades 36 and the perforations 39 is changeless during rotation of the rotary blades 36. Thus, cooling air entering the interior of the annular wall 38 via the perforations 39 flows directly to the low-pressure areas to increase the air pressure thereat effectively.

In addition, the annular wall 38 surrounding the rotary blades 36 guides airflow smoothly into the air inlet 21 via the guiding portion 381. Furthermore, the annular wall 38 and the outer ends 362 of the rotary blades 36 are portions of a single, one-piece, monolithic body without any internal seams. This integral structure of the annular wall 38 and the outer ends 362 of the rotary blades 36 enhances the mechanical integrity of the heat dissipation fan 50, such that operating noise of the heat dissipation fan 50 is reduced.

Figure 5:
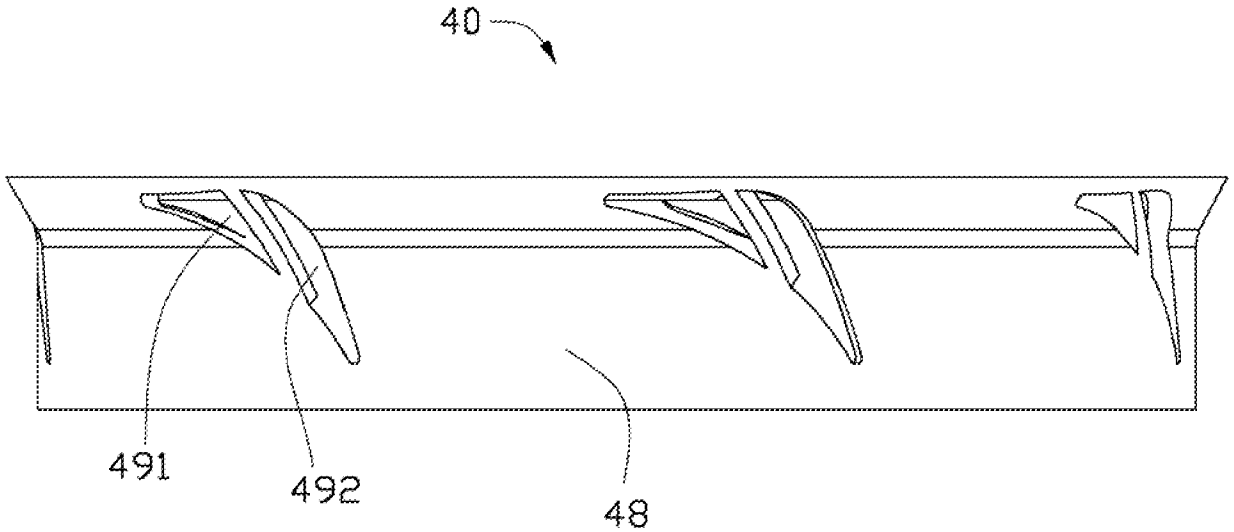
FIG. 5 is a side view of a rotor of a heat dissipation fan according to a second embodiment.

The perforations 39 disclosed in the first embodiment each have a generally falcate outline, and a number of the perforations 39 is equal to a number of the rotary blades 36. Alternatively, either or both of the shape and the number of the perforations 39 can be varied. FIG. 5 shows a second embodiment of a rotor 40 for a heat dissipation fan, the rotor 40 differing from the rotor 30 of the first embodiment in that the perforations outnumber the rotary blades 36, and the perforations each have an outline different from the perforations 39. In the rotor 40, two separate perforations, a first perforation 491 and a second perforation 492, are defined between each two neighboring rotary blades 36. The first perforation 491 has a generally triangular outline. The second perforation 492 has a generally parallelogram-shaped outline. The first perforation 491 and the second perforation 492 are located adjacent to the leeward lateral surface 366 of a front rotary blade 36 of each two neighboring rotary blades 36 along the rotation direction of the rotor 40. Therefore, during operation, cooling air around the outside of an annular wall 48 can enter the interior of the annular wall 48 via the first perforations 491 and the second perforations 492 simultaneously and be directly guided to the low-pressure areas adjacent to the leeward lateral surfaces 366 of the rotary blades 36.

Figure 6:
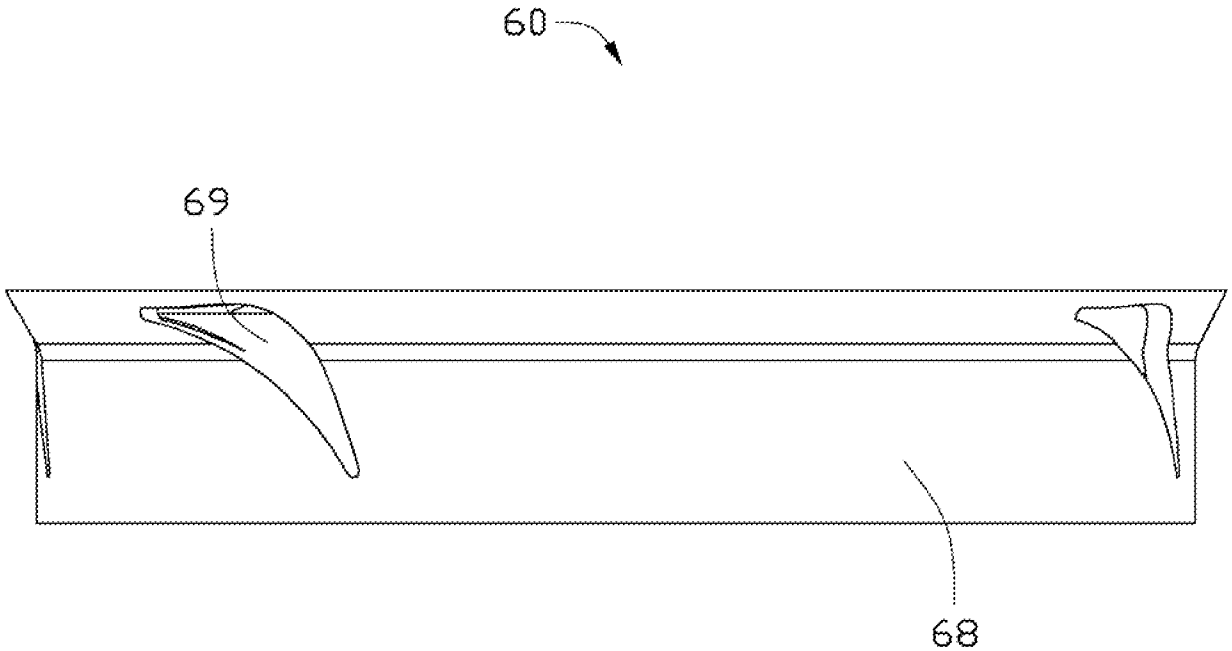
FIG. 6 is a side view of a rotor of a heat dissipation fan according to a third embodiment.

FIG. 6 shows a third embodiment of a rotor 60 for a heat dissipation fan, the rotor 60 differing from the rotor 30 of the first embodiment in that the number of perforations 69 is fewer than the number of rotary blades 36. Each perforation 69 is located between two corresponding neighboring rotary blades 36, and is adjacent to the leeward lateral surface 366 of the leading rotary blade 36 of the two neighboring rotary blades 36. In this embodiment, for example, there may be eight rotary blades 36, and four perforations 69. The perforations 69 are evenly distributed around a circumference of an annular wall 68.

It is to be understood, however, that even though numerous characteristics and advantages of various embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A rotor, comprising:

a hub;

a plurality of rotary blades extending outwardly from the hub, each rotary blade comprising a windward lateral surface and a leeward lateral surface at opposite sides thereof; and an annular wall surrounding the rotary blades and adjoining the outer ends of the rotary blades and being rotatable therewith, a perforation defined in the annular wall between two neighboring rotary blades and being adjacent to the leeward lateral surface of a leading rotary blade of the neighboring rotary blades, the perforation comprising a first curved surface and a second curved surface connected with two opposite ends of the first curved surface, a portion of the first curved surface and the leeward lateral surface of the leading rotary blade cooperatively forming a single curved surface.

2. The rotor of claim 1, wherein each rotary blade is shaped so as to form varying angles with respect to an axis of the rotor.

3. The rotor of claim 2, wherein each rotary blade comprises an inner end adjoining the hub, an angle defined between the outer end of each rotary blade and the axis of the rotor exceeding a corresponding angle defined between the inner end of the each rotary blade and the axis of the rotor, and a height of the annular wall along the axis of the rotor being substantially the same as a corresponding height of each of the rotary blades.

4. The rotor of claim 1, wherein the perforation is generally falcate.

5. The rotor of claim 1, wherein the annular wall comprises a guiding portion at a top and a main enclosing portion below the guiding portion, an air inlet is defined at a top end of the guiding portion, the guiding portion has a diameter gradually decreasing from top to bottom along an axis of the rotor, and the main enclosing portion has a constant diameter along the axis of the rotor.

6. The rotor of claim 5, wherein the perforation spans through both the guiding portion and the main enclosing portion, the perforation at the main enclosing portion defining a surface which is a smooth continuation of part of the outer end of the leeward lateral surface of the leading rotary blade.

7. The rotor of claim 1, further comprising at least one other perforation defined in the annular wall, each perforation of all the perforations being adjacent to the leeward lateral surface of a leading rotary blade of two corresponding neighboring rotary blades.

8. The rotor of claim 7, wherein the number of perforations is the same as the number of rotary blades.

9. The rotor of claim 7, wherein the number of perforations is twice the number of rotary blades.

10. The rotor of claim 7, wherein the number of perforations is fewer than the number of rotary blades.

11. The rotor of claim 10, wherein the number of perforations is half the number of rotary blades.

12. An axial heat dissipation fan, comprising:

an air inlet and an air outlet defined at opposite ends of the heat dissipation fan;

a base disposed at the air outlet;

a central tube extending upwardly from the base towards the air inlet; and a rotor rotatably supported by the central tube, the rotor comprising a hub, a plurality of rotary blades extending outwardly from the hub, and an annular wall surrounding the rotary blades and adjoining the outer ends of the rotary blades and being rotatable therewith, each rotary blade comprising a windward lateral surface and a leeward lateral surface at opposite sides thereof, a perforation defined in the annular wall between two neighboring rotary blades and being adjacent to the leeward lateral surface of a leading rotary blade of the neighboring rotary blades.

13. The axial heat dissipation fan of claim 12, wherein each rotary blades is oriented at varying angle with respect to an axis of the rotor, each rotary blade comprising an inner end connected to the hub, an angle formed between the outer end of each rotary blade and the axis of the rotor exceeding an angle formed between the inner end of each rotary blade and the axis of the rotor.

14. The axial heat dissipation fan of claim 12, wherein the perforation comprises a first curved surface and a second curved surface connected with two opposite ends of the first curved surface, a portion of the first curved surface and the leeward lateral surface of the leading rotary blade cooperatively forming a single curved surface.

15. The axial heat dissipation fan of claim 12, wherein another perforation is defined in the annular wall and located between the two neighboring rotary blades, adjacent to the leeward lateral surface of the leading rotary blade.

16. The axial heat dissipation fan of claim 12, wherein the base comprises a supporting portion surrounded by an annular fixing portion, a plurality of ribs connecting the supporting portion with the fixing portion, and a plurality of fixing ears extending outwardly from the fixing portion, each of the fixing ears defining a hole therein.

17. The axial heat dissipation fan of claim 16, wherein the air outlet is defined between the supporting portion and the fixing portion.

18. A rotor, comprising:

a hub;

a plurality of rotary blades extending outwardly from the hub, each rotary blade comprising a windward lateral surface and a leeward lateral surface at opposite sides thereof; and an annular wall surrounding the rotary blades and adjoining the outer ends of the rotary blades and being rotatable therewith, a perforation defined in the annular wall between two neighboring rotary blades and being adjacent to the leeward lateral surface of a leading rotary blade of the neighboring rotary blades, the annular wall comprising a guiding portion at a top and a main enclosing portion below the guiding portion, an air inlet being defined at a top end of the guiding portion, the guiding portion having a diameter gradually decreasing from top to bottom along an axis of the rotor, the main enclosing portion having a constant diameter along the axis of the rotor.

19. The rotor of claim 18, wherein the perforation spans through both the guiding portion and the main enclosing portion, the perforation at the main enclosing portion defining a surface which is a smooth continuation of part of the outer end of the leeward lateral surface of the leading rotary blade.

* * * * *